US006834982B2

(12) United States Patent
Dedoro

(10) Patent No.: US 6,834,982 B2
(45) Date of Patent: Dec. 28, 2004

(54) SPOTLIGHT WITH PERIMETRICAL DELIMITATION OF THE EMITTED LIGHT BEAM

(75) Inventor: Bruno Dedoro, Castel Goffredo (IT)

(73) Assignee: Coemar S.p.A., Castel Goffredo (IT)

( * ) Notice: Subject to any disclaimer, the term of this patent is extended or adjusted under 35 U.S.C. 154(b) by 112 days.

(21) Appl. No.: 10/270,376

(22) Filed: Oct. 15, 2002

(65) Prior Publication Data

US 2004/0017685 A1 Jan. 29, 2004

(30) Foreign Application Priority Data

Jul. 23, 2002 (IT) ..... MI2002A001625

(51) Int. Cl.[7] ..... F21V 29/00

(52) U.S. Cl. ..... 362/268; 362/270; 362/272; 362/280; 362/283; 362/284; 362/323; 362/324; 362/321; 362/293

(58) Field of Search ..... 362/260, 268, 362/269, 270, 271, 272, 277, 280, 281, 282, 283, 284, 319, 322, 323, 324, 326, 331, 321, 293

(56) References Cited

U.S. PATENT DOCUMENTS

| | | | | | |
|---|---|---|---|---|---|
| 2,229,004 | A | * | 1/1941 | Peters | 362/383 |
| 4,462,067 | A | * | 7/1984 | Altman | 362/268 |
| 4,468,720 | A | * | 8/1984 | Arai | 362/281 |
| 5,295,056 | A | * | 3/1994 | Peck | 362/267 |
| 5,311,411 | A | * | 5/1994 | Garolfi | 362/493 |
| 5,904,417 | A | * | 5/1999 | Hewett | 362/321 |
| 2003/0076682 | A1 | * | 4/2003 | Tanaka et al. | 362/280 |

* cited by examiner

*Primary Examiner*—Stephen Husar
*Assistant Examiner*—Sharon Payne
(74) *Attorney, Agent, or Firm*—Guido Modiano; Albert Josif; Daniel O'Byrne

(57) ABSTRACT

A spotlight with perimetrical delimitation of the emitted light beam, comprising a light source for emitting a light beam, an optical element that can move axially with respect to the light beam in order to adjust the breadth of the light beam, and a Fresnel lens for diffusing the light beam. Beam adjusting elements are provided for delimiting perimetrically the light beam which are associated with the optical element and can move axially with it.

6 Claims, 6 Drawing Sheets

SPOTLIGHT WITH PERIMETRICAL DELIMITATION OF THE EMITTED LIGHT BEAM

BACKGROUND OF THE INVENTION

The present invention relates to a spotlight with perimetrical delimitation of the emitted light beam.

As is known, in spotlights, which are used typically in the field of entertainment to project beams of light, means are provided that allow to delimit perimetrically the light beam.

These means are generally constituted by external flaps, which are placed on the projector at the region where the light beam is emitted.

This kind of solution is not welcomed by users, since the protruding flaps often break and also do not allow versatility in shaping the emitted light beam.

Other known solutions, which provide for less bulky embodiments, arrange the beam delimiting flaps at the fixed focal point, thus providing a screen in a fixed position that does not allow to delimit the light beam in an optimum manner, especially in combination with the use of the zoom, which changes the breadth of the emitted light beam.

SUMMARY OF THE INVENTION

The aim of the invention is indeed to solve the problem described above, by providing a spotlight with perimetrical delimitation of the emitted light beam, which can be positioned inside the spotlight but at the same time allow to provide automatically a vast range of shapes, with the possibility to move the emitted light beam.

Within this aim, an object of the invention is to provide a spotlight in which it is possible to provide a soft masking of the perimetric edge, obtaining also fading diffuse edges that are particularly pleasant from an aesthetic standpoint.

Another object of the present invention is to provide a spotlight that by virtue of its particular constructive characteristics is capable of giving the greatest assurances of reliability and safety in use.

Another object of the present invention is to provide a spotlight with means for delimiting perimetrically the emitted light beam that can be obtained easily starting from commonly commercially available elements and materials and is further competitive from a merely economical standpoint.

This aim and these and other objects that will become better apparent hereinafter are achieved by a spotlight with perimetrical delimitation of the emitted light beam, according to the invention, which comprises a light source for emitting a light beam, an optical element that can move axially with respect to said light beam in order to adjust the breadth of the light beam, and a Fresnel lens for diffusing the light beam, characterized in that it comprises beam adjusting means for delimiting perimetrically said light beam which are associated with said optical element and can move axially with it.

BRIEF DESCRIPTION OF THE DRAWINGS

Further characteristics and advantages will become apparent from the description of a preferred but not exclusive embodiment of a spotlight with means for delimiting perimetrically the emitted light beam, illustrated only by way of non-limitative example with the aid of the accompanying drawings, wherein.

DESCRIPTION OF THE PREFERRED EMBODIMENTS

Figure 1:
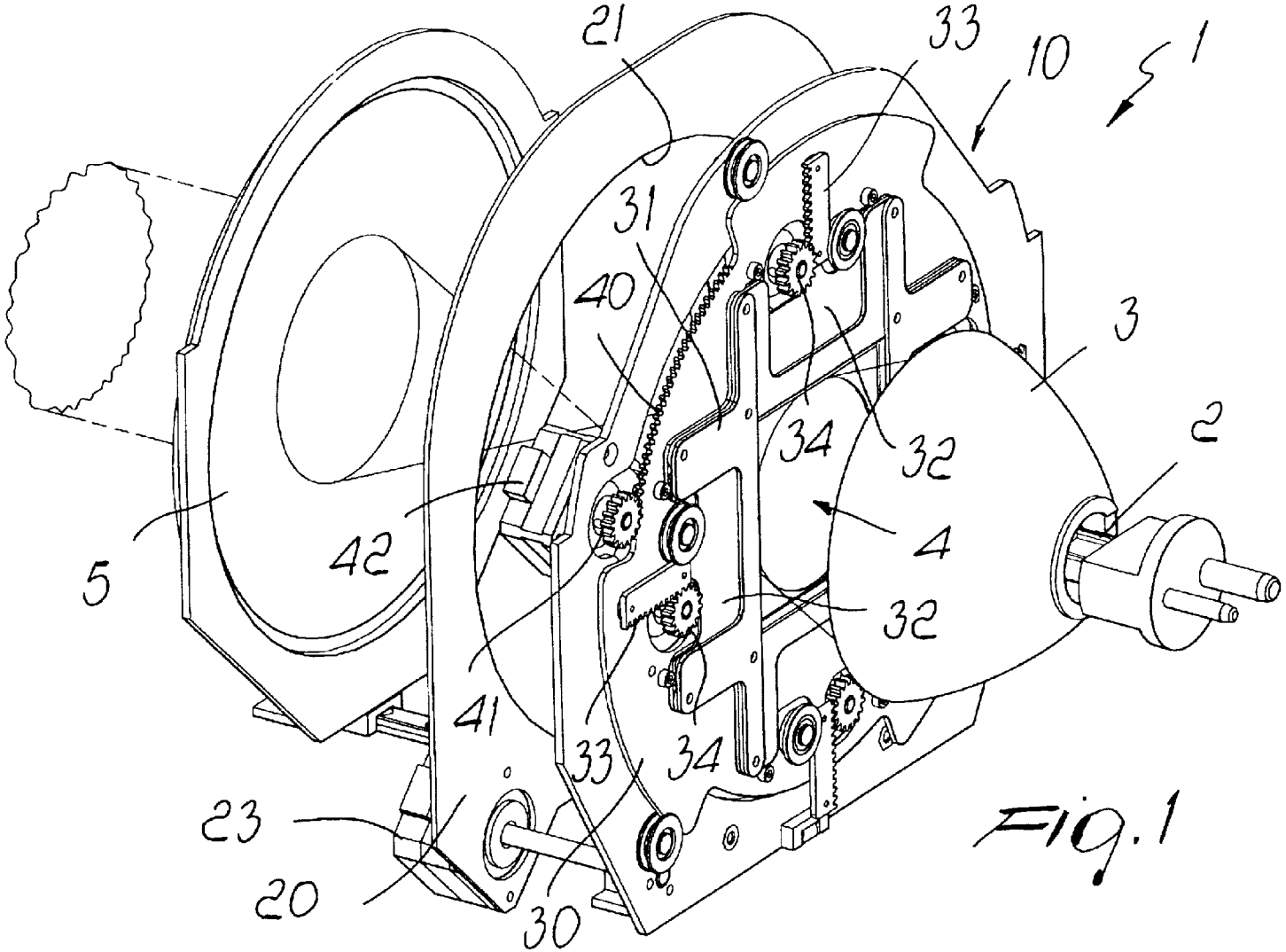
FIG. 1 is a schematic perspective view of the spotlight.
Figure 2:
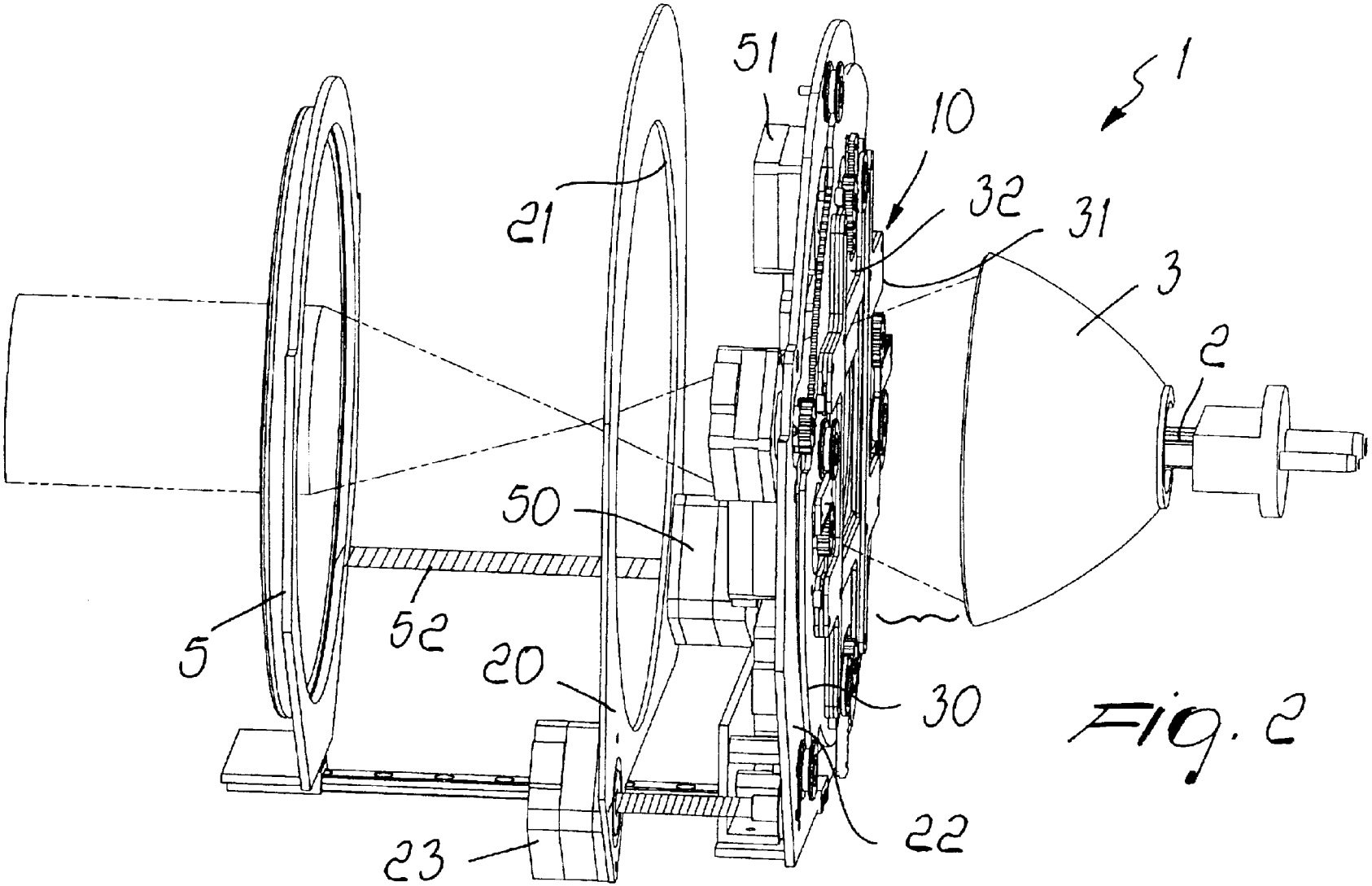
FIG. 2 is a schematic lateral perspective view of the spotlight.
Figure 3:
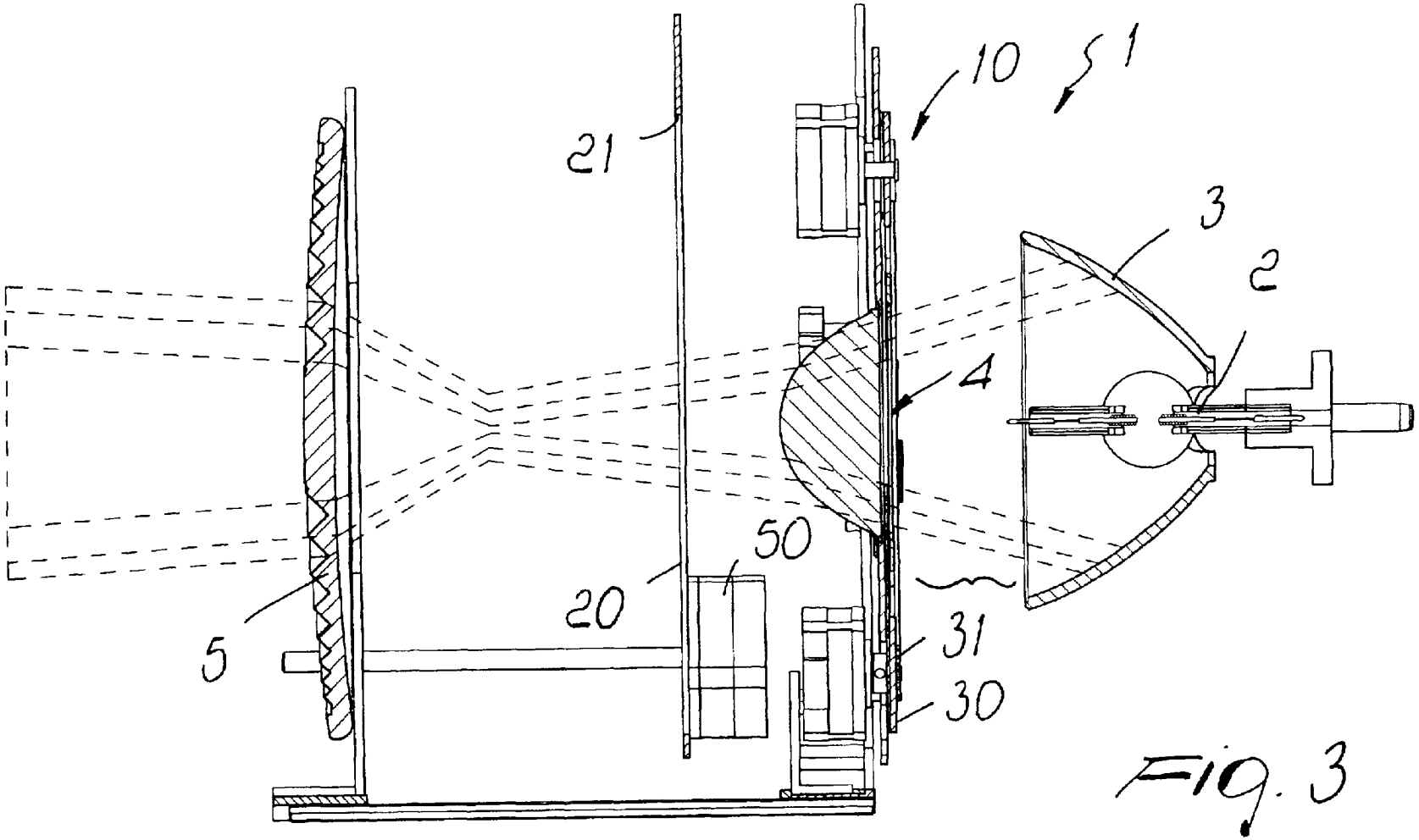
FIGS. 3 and 4 are lateral elevation views of the projector in two different operating positions.
Figure 4:
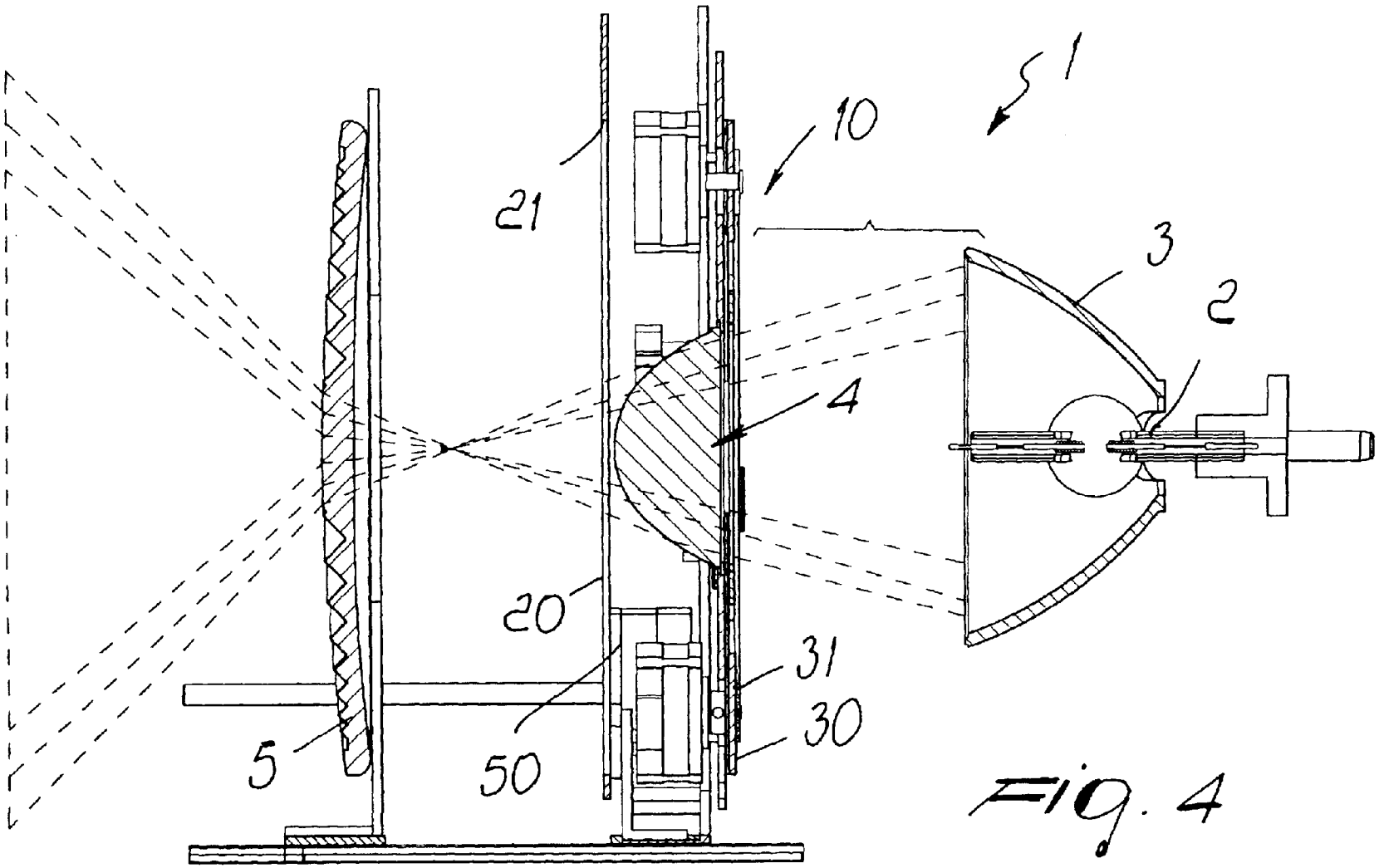

With reference to the figures, the spotlight with means for delimiting perimetrically the emitted light beam, generally designated by the reference numeral 1, comprises a light source that is constituted by a lamp 2, preferably of the high-power discharge type, which is arranged inside a parabolic reflector 3 for emitting a light beam.

An optical element 4 is interposed on the light beam and is usually constituted by a planoconvex, parabolic or elliptical lens that can move axially along the light beam.

A Fresnel lens 5 is provided and spaced from the optical element and is meant to diffuse the emitted light beam.

The particularity of the invention is constituted by the fact that it comprises beam adjusting means for delimiting perimetrically the light beam, which are generally designated by the reference numeral 10, are mechanically and operatively associated with the optical element constituted by the lens 4, and can move axially with it.

In constructive detail, the beam adjusting means 10 comprise a fixed plate 20 with a through opening 21, through which the light beam is passed.

A movable plate 22 is further provided so as to face the fixed plate 20 and is connected to a motor 23 supported on the fixed plate for the axial movement of the movable plate.

Beam delimiting elements are provided on the movable plate 22 that supports the lens 4 and are constituted by a rotating plate 30, which supports a grid 31 on which laminas acting as laminar shutters 32 can slide; said shutters have a tang 33 shaped as a rack for the engagement with pinions 34 of the laminas 32, which are actuated by an actuation motor 51 and allows to actuate with a translational motion the laminas 32 in order to interpose them in the light beam.

The rotating plate 30 is provided perimetrically with a toothed sector 40, which covers a circumferential portion and with which a rotation pinion 41, actuated by a rotational motor 42, supported on said fixed plate, engages for actuation.

With the arrangement described above, the movable plate that supports the laminas 33 for delimiting the light beam can be made to perform an axial translational motion in the light beam, according to the aperture to be provided on the light beam, by way of an axial translational motion motor with a threaded bar 23, which produces a zoom action in combination with the Fresnel lens 5, which in turn is connected, by means of a threaded bar 52, to a motor 50 for the Fresnel lens, which allows to produce the axial translational motion of the Fresnel lens.

The delimiting elements, in addition to performing a radial translational motion with respect to the light beam, can be rotated by virtue of the fact that they are supported by the rotating plate 30, which is turned by means of the motor 42.

Figure 5:
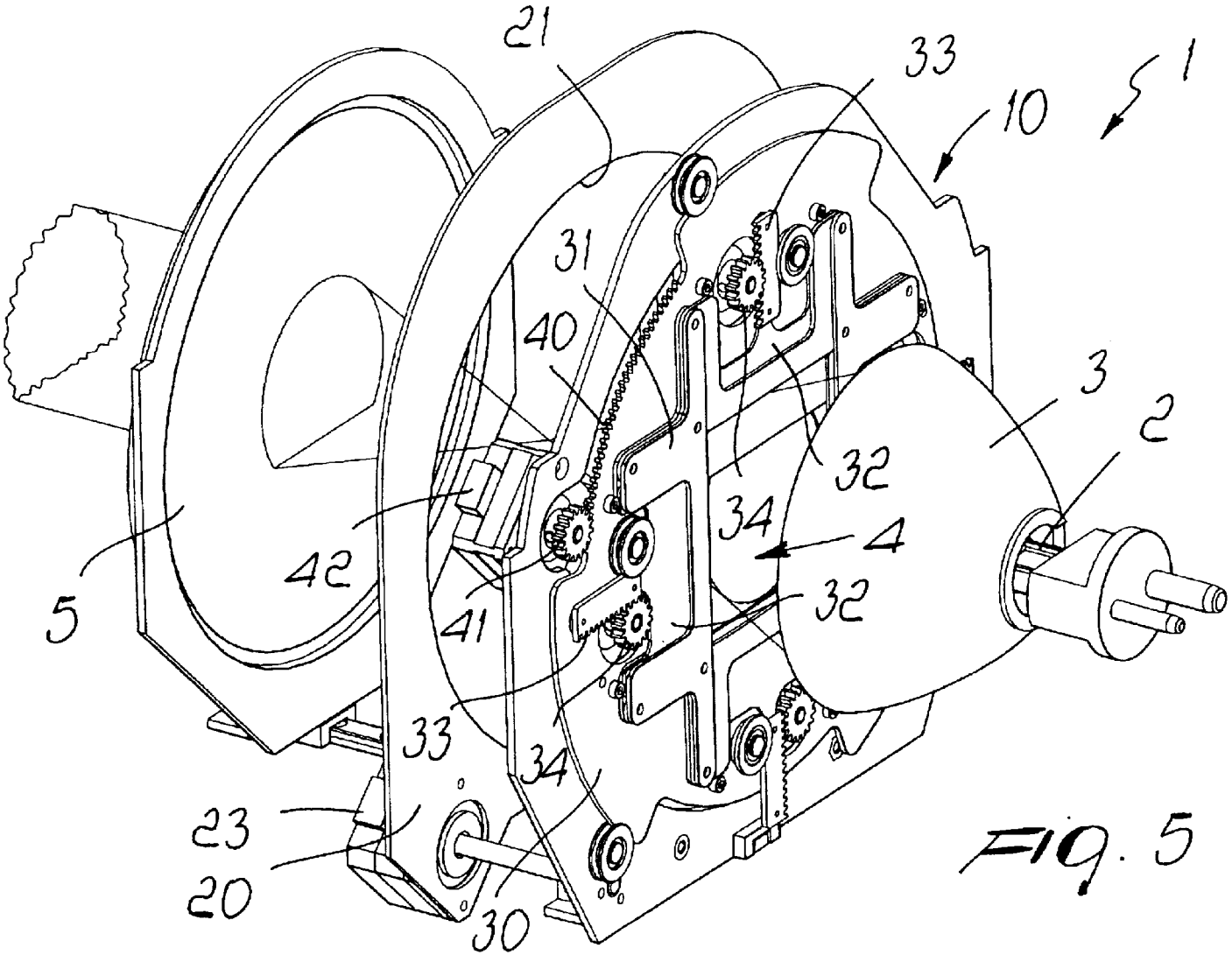
FIG. 5 is a perspective view of the projector, showing the emission of a shaped beam.
Figure 6:
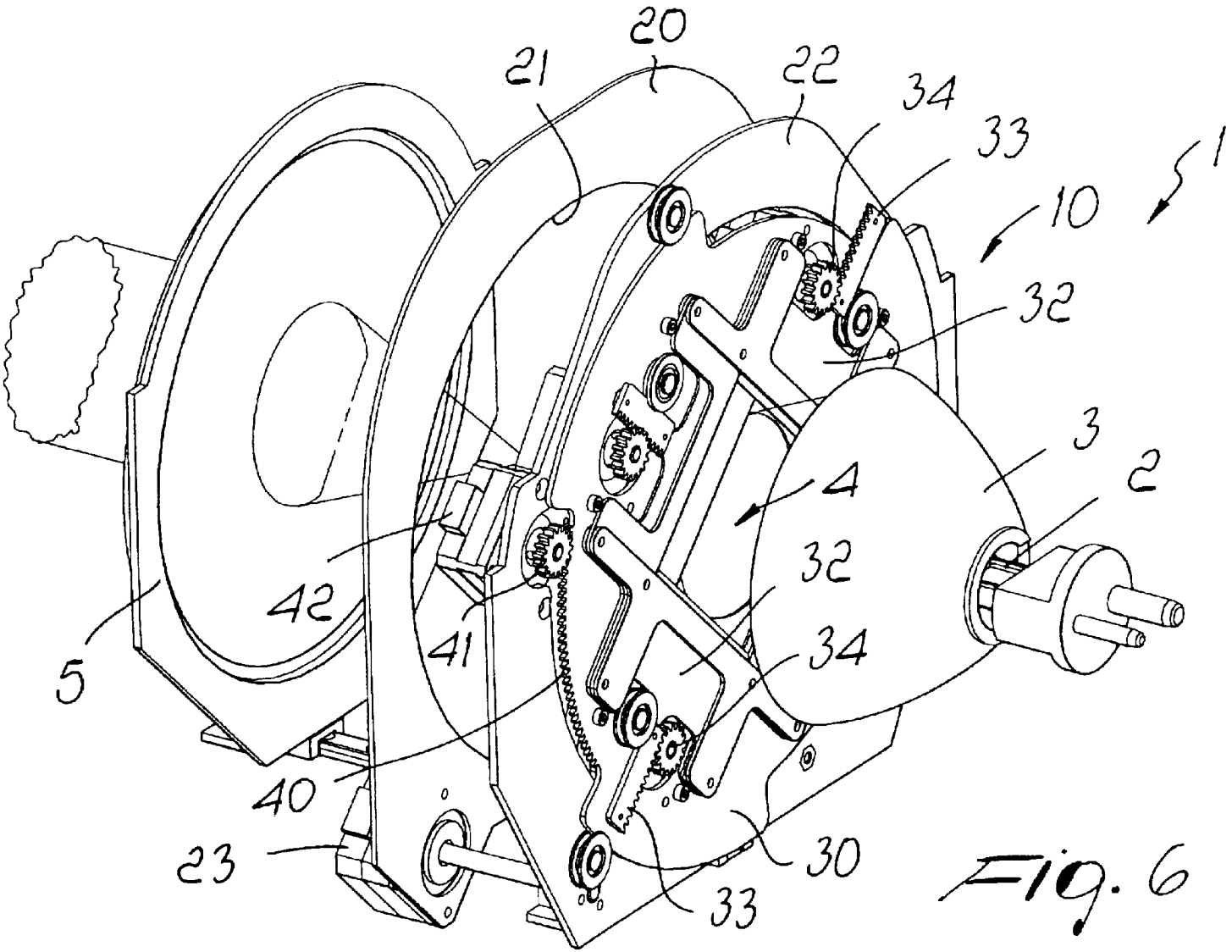
FIG. 6 is a view of the projector, showing the rotation of the emitted contoured beam.

It is thus possible to produce shaped light beams, for example semicircular ones, as shown in FIG. 5, by using for example a lamina that delimits a portion of the light beam, and it is also possible to rotate the resulting image by acting on the motor 42, which turns the plate 30, as shown schematically in FIG. 6.

From the above description it is thus evident that the invention achieves the intended aim and objects, and in particular the fact is stressed that laminas are provided which are interposed in the light beam and are arranged inside the projector but can follow the optical element, which moves rigidly with them in an axial direction, so that the perimetric delimitation of the light beam is always correct and is not influenced by the different aperture of the light beam that can be obtained with the optical zoom that can be provided by virtue of the translational motion of the optical element.

The invention thus conceived is susceptible of numerous modifications and variations, all of which are within the scope of the appended claims.

Moreover, it is noted that anything found to be already known during the patenting process is understood not to be claimed and to be deleted from the claims.

All the details may further be replaced with other technically equivalent elements, and in practice the materials used, as well as the contingent shapes and dimensions, may be any according to requirements.

The disclosures in Italian Patent Application No. MI2002A001625 from which this application claims priority are incorporated herein by reference.

What is claimed is:

1. A spotlight with perimetrical delimitation of the emitted light beam, comprising: a light source for emitting a light beam along a Light path; an optical element movable axially with respect to the light beam to adjust a breadth of the light beam; a Fresnel lens arranged on the light path for diffusing the light beam; and beam adjusting means arranged at said light path for delimiting perimetrically the light beam, said beam adjusting means being mechanically and operatively associated with said optical element for joint axial movement.

2. The spotlight of claim 1, wherein said beam adjusting means comprise: a fixed plate with a through opening allowing passage of the light beam; a movable plate and an actuation motor supported at said fixed plate, and operatively connected to said movable plate for actuating the movable plate to carry out axial movement.

3. The spotlight of claim 2, wherein said optical element is supported by said movable plate.

4. The spotlight of claim 3, wherein said beam adjusting means further comprise: delimiting elements which include a rotating plate that rotates about an axis of the light beam; a grid supported on said rotating plate; and shutters with laminas which are provided on said grid and are slideable radially with respect to the axis of the light beam.

5. The spotlight of claim 4, wherein said beam adjusting means further comprise at least one pinion for translational actuation of said laminas, said shutters with laminas being provided with a rack-like tang that engages a said at least one pinion.

6. The spotlight of claim 4, wherein a rotation motor and rotation pinion are further provided on said fixed plate, said rotating plate being provided perimetrically with a toothed sector that runs along a circumferential portion thereof, said rotation pinion, actuated by said rotation motor, engaging said toothed sector for actuation of said rotating plate.

* * * * *